US007255767B2

(12) United States Patent
Rice et al.

(10) Patent No.: US 7,255,767 B2
(45) Date of Patent: Aug. 14, 2007

(54) SINGLE HAND OPERATION ADHESIVE TAPE DISPENSER

(76) Inventors: Kieran A. Rice, 5802 Tanagerside Rd., Lithia, FL (US) 33547; Elizabeth J. Rice, 5802 Tanagerside Rd., Lithia, FL (US) 33547

( * ) Notice: Subject to any disclaimer, the term of this patent is extended or adjusted under 35 U.S.C. 154(b) by 0 days.

(21) Appl. No.: 11/328,478

(22) Filed: Jan. 9, 2006

(65) Prior Publication Data

US 2007/0158017 A1 Jul. 12, 2007

(51) Int. Cl.
*B26F 3/02* (2006.01)
*B65H 35/07* (2006.01)
*B32B 38/04* (2006.01)

(52) U.S. Cl. ..... 156/253; 156/523; 156/574; 156/577; 225/51; 225/52; 225/74; 225/85

(58) Field of Classification Search ..... 156/523, 156/526, 574, 577, 579, 253; 225/43, 60, 225/72, 73, 74, 85, 86, 51, 52
See application file for complete search history.

(56) References Cited

U.S. PATENT DOCUMENTS 3,104,043 A * 9/1963 Wyant ..... 225/51
4,466,563 A * 8/1984 Zuss ..... 225/74
4,582,558 A * 4/1986 Antonson ..... 156/523
5,222,644 A * 6/1993 Moreno ..... 225/19
5,288,362 A * 2/1994 Shuh-Chin ..... 156/523
5,861,080 A * 1/1999 Yang et al. ..... 156/576
6,453,970 B1 * 9/2002 Stone et al. ..... 156/579
7,017,639 B2 * 3/2006 McDonald ..... 156/527
2004/0016509 A1 * 1/2004 Lissoni ..... 156/523

* cited by examiner

*Primary Examiner*—Mark A. Osele

(57) ABSTRACT

A hand-held adhesive tape dispenser/applicator comprising a housing shell (1) including a hub (2) for mounting adhesive tape rolls, a tape discharge opening (13) and a lever mechanism (3). The lever mechanism (3) comprising pivotally mounted levers actuated by movement of the dispenser housing during the tape application and cutting process providing means for locking the tape whilst cutting, preventing roll back of tape end and an anti-locking function enabling smooth passage of tape whilst dispensing. Dispensing tape passes over a tape guide applicator (4), when a requisite length of tape is applied a user tilts the housing shell (1) engaging a cutter lever (6) with the tape actuating a tape depressor lever (5) which depresses and adheres a section of tape to the housing shell (1). As tape is severed a new tape end remains adhered until released by the next application. When inverted, the dispenser/applicator is free-standing and dispenses tape in desktop mode.

9 Claims, 2 Drawing Sheets

SINGLE HAND OPERATION ADHESIVE TAPE DISPENSER

CROSS REFERENCE TO RELATED APPLICATIONS

"Not Applicable"

STATEMENT REGARDING FEDERALLY SPONSORED RESEARCH OR DEVELOPMENT

"Not Applicable"

REFERENCE TO SEQUENCE LISTING

"Not Applicable"

BACKGROUND OF THE INVENTION

Adhesive tape dispensers are available generally in the form of desktop tape dispensers and hand-held tape dispensers and requiring the use of two hands, some of which dispensers apply tape directly to a surface. However, these dispensers have problems with preventing tape from unreeling tape cutting, prevention of tape from retracting into the dispenser after cutting, tape adhering inadvertently to the dispenser housing and contamination of the protruding tape end when not in use. Other dispensers are unable to satisfactory overcome these problems economically or require multiple components and elaborate mechanisms, friction or gravity to alleviate the problems. Suitability of such tape dispensers is premised upon minimizing the cost of manufacture whilst maintaining the functionality of the dispenser. This invention overcomes all the hand-held dispenser/applicator issues and also functions as a freestanding desk top tape dispenser.

BRIEF SUMMARY OF THE INVENTION

The object of the invention describe herein is to provide a tape dispenser/applicator which is compact in size, has few components, can perform as a hand-held and/or desk top dispenser with tape locking and anti locking capabilities and which can be operated easily with one hand. The tape dispenser/applicator comprises a housing with a holder for a roll of adhesive tape, a tape discharge opening and a pivoting lever mechanism comprising a tape depressor lever, a cutter lever with a cutting edge and a tape guide applicator, wherein the lower mechanism is mounted close to the discharge opening. The lever mechanism providing a device for regulating passage of tape from the dispenser by allowing the tape to unreel freely from the roll whilst being applied to a substrate, to lock and prevent the tape from unreeling whilst the tape is being cut and to secure the tape end from retracting or falling back into the housing after use.

To operate the dispenser/applicator, a protruding tape end at the discharge opening is applied to a substrate surface by the tape guide applicator at a shallow angle relative to the substrate the user pressing the tape guide applicator lightly against the substrate surface. The dispenser/applicator is pulled back along the substrate until a desired length of tape is applied, whereupon the dispenser/applicator is tilted about the guide applicator which engages a cutter lever to the tape and pivots the cutter lever rotating the depressor lever causing it to lock the unreeling tape whilst it is cut at a cutting edge located on the lever arm and secures the new tape end preventing roll back of the tape end into the dispenser and ready for the next taping application.

A feature of this invention is that the lever mechanism allows the dispenser/applicator to also function as a desktop dispenser when the dispenser/applicator is inverted and freestanding on a stable surface.

BRIEF DESCRIPTION OF THE DRAWINGS

In these drawings, the same reference signs are always used to denote the same parts, and any explanation given once is valid for all diagrams unless otherwise stated.

DETAILED DESCRIPTION OF THE INVENTION

Figure 1:
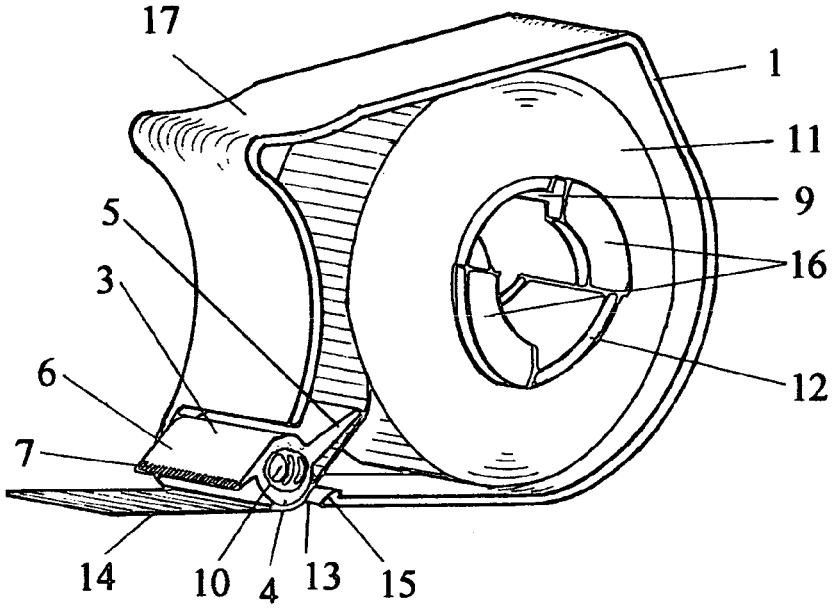
FIG. 1 a diagram in perspective of the assembled dispenser/applicator including a tape roll in hand-held application mode, FIG. 2 a diagram in perspective in exploded view of the dispenser/applicator without a tape roll, FIG. 3 a front elevational view of the dispenser/applicator in hand-held mode showing the dispenser/applicator applying tape to a substrate with the depressor lever pressing against the unreeling tape preventing the discharge opening from closing, FIG. 4 a front elevational view of the dispenser/applicator in hand-held mode showing the dispenser/applicator in the tape cutting position with unreeling tape locked between the depressor lever and dispenser lip, FIG. 5 a front elevational view of the dispenser/applicator in desk top mode and the configuration of the dispenser/applicator whilst standing when not in hand-held use.

The drawings show an open faced housing shell 1 comprising a support surface with a peripheral wall extending transversely from the support surface. The housing fits in the palm of one hand and is supported and gripped by the fingers of one hand. The housing may be constructed of any suitable material such as thermoplastic. The housing contains a hub 2 (preferably hollow) including spring fingers 9 upon which an adhesive tape roll 11 wound around a spool 12 is mounted. A tape roll 11 on a spool 12 is snapped over the spring finger 9 which prevent the tape roll 11 from slipping off the hub 2 whilst allowing the tape spool 12 to rotate freely. The outer diameter of the hub 2 and the inner diameter of the spool 12 are such that the spool 12 may rotate about the hub 2. The outer diameter of the tape roll 11 is slightly smaller than the internal dimensions of the housing shell 1 such that it fills the space almost completely thus allowing the dispenser to be handled and manipulated more easily by the user. A preferred embodiment of the dispenser would dispense standard width 0.50 inch (12.7 mm) wide and 0.75 inch (19 mm) wide adhesive tape in lengths between 300 inches (7.62 m) and 1400 inches (35.59 m) on standard, approximately 1.00 inch (25 mm) internal diameter, spools in common use in homes schools and offices. The mechanism described herein is scalable and may readily be adapted to accommodate any width and size of tape roll however, tape rolls over 3.00 inches (75 mm) wide would generally be considered unwieldly for single handed operation.

As can be seen from FIG. 1 the housing shell 1 also comprises a tape discharge opening 13 which comprises a variable size opening between a dispenser lip 15 formed in the peripheral wall of the housing shell 1 and a lever mechanism 3 pivotally mounted near the discharge opening 13, the dispenser lip 15 comprises a raised area of the peripheral wall of the housing shell 1 at the tape discharge opening 13 and to which a small section of unreeled tape is pressed and adhered by rotation of the depressor lever 5. The lever mechanism 3 provides a tape locking device whilst tape is being cut thereby preventing tape from unreeling, and a tape anti lock device preventing the tape from locking or adhering to the housing whilst tape is being applied. The lever mechanism 3 also secures the new tape end 14 preventing it from withdrawing into the housing shell 1 when not in use.

The lever mechanism 3 comprises two levers pivotally mounted approximately diametrically and radially about a spindle 8. The spindle 8 includes spring fingers 10 over which the lever mechanism 3 is snapped to enable rotation loosely about the spindle 8. The levers include a tap depressor lever 5 and a tape cutter lever 6. The tape depressor lever 5 is oriented towards the tape roll 11 and, when actuated by movement of the cutter lever, provides a means of depressing tape unreeling from the tape roll 11 so as to squeeze a small section of tape against the dispenser lip 15 at the tape discharge opening 13 adhering it thereto. The cutter lever 6 is oriented downstream of the discharge opening 13 and includes at its extremity a cutting edge 7 comprising a serrated edge including a plurality of teeth for cutting unreeled and applied adhesive tape. In this preferred embodiment the lever mechanism 3 includes a tape guide applicator 4 located on the underside of the lever mechanism 3, the tape guide applicator 4 having a curved pressing surface located between the cutter lever 6 and tape depressor lever 5. In an alternative embodiment the guide applicator 4 is mounted independently from the lever mechanism 3 or as an integral part of the housing shell 1 in the proximity of the lever mechanism 3.

Figure 3:
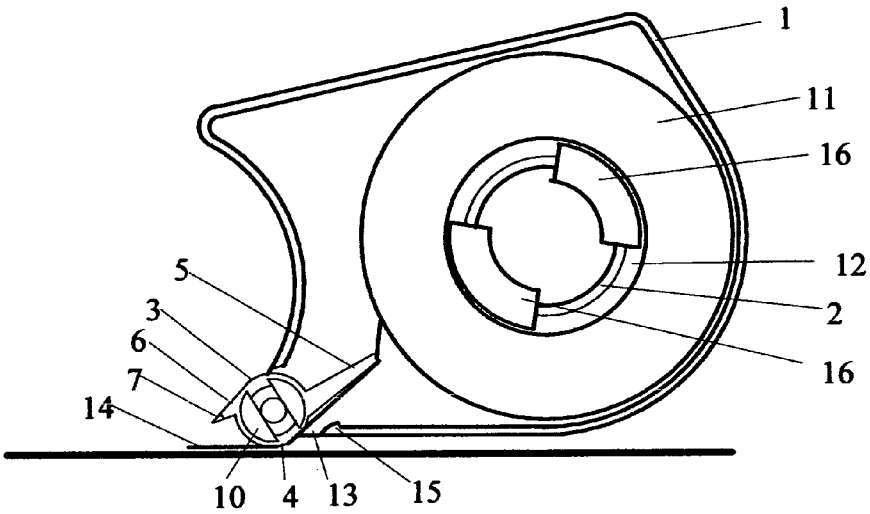
Figure 4:
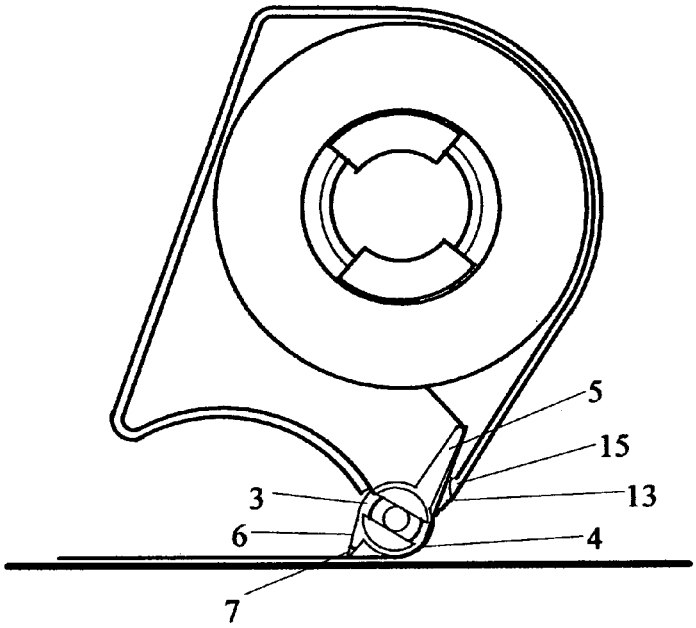

At the commencement of a taping application a user presses the tape guide applicator 4 against a tape end 14 protruding from the discharge opening 13 against a substrate surface with the adhesive face against the substrate. Pressing the tape end to the substrate causes the adhesive tape to adhere to the substrate and, as the user draws the tape dispenser back across the substrate; adhesive tape unreels from the tape roll 11 and passes smoothly under the tape guide applicator 4 adhering tape to the substrate as is shown in FIG. 3. When a requisite length of tape has been applied, the housing shell 1 is tilted to an inclined plane as is shown in FIG. 4 whilst the user maintains pressure on the guide applicator 4. This causes the cutting edge 7 to engage the tape at the substrate and the lever mechanism 3 to pivot about the spindle 8 and press the depressor lever 5 against the unreeling tape causing a small section of the unreeling tape to be squeezed against, and adhered to, the dispenser lip 15 at the discharge opening 13 thereby preventing the tape roll 11 from unreeling further. Further tilting of the housing shell 1 accompanied by slight backward pressure on the housing shell 1 against the direction of travel causes the tape to sever at the cutting edge 7. When the tape is severed the depressor lever 5 stops squeezing the tape against the dispenser lip 15 however, the new tape end remains lightly adhered to the dispenser/applicator at the dispenser lip 15 preventing the protruding tape end 14 from retracting into the housing shell 1. At the commencement of the next taping application the small section of tape lightly adhered at the dispenser lip 15 becomes detached when the protruding tape end 14 is applied to a substrate and the housing drawn backward during the next taping application.

The position and length of the depressor lever 5 is such that it is prevented from closing the discharge opening 13 whilst tape is being applied by reason of the depressor lever 5 bearing upon the unreeling tape, which is under tension as it unreels thereby restricting rotation of the depressor lever 5 and consequential closing of the discharge opening 13.

The lever mechanism 3 enables adhesive tape to be applied to substrates in any orientation—horizontal, vertical and inverted. The embodiment shown in the drawings includes wide lugs 16 on the hub 2 spring fingers 9 angled as shown to provide support for the users thumb when dispensing tape in hand held mode. The preferred method of gripping and supporting the dispenser whilst in hand held mode is with the thumb on the hub spring finger lugs 16, the middle finger on the outer face of the housing shell 1 in the vicinity of the hub 2 mounting and the index finger upon the housing shell 1 above the lever mechanism 3 where a shallow depression 17 is provided to support the index finger.

This tape dispenser/applicator also removes a common problem with hand-held tape dispenser/applicators which is contamination of the tape end. This dispenser may be inverted to stand on a stable surface with the protruding tape end 14 uppermost as shown in FIG. 5 keeping the protruding tape end 14 clear of potential contaminants.

Figure 2:
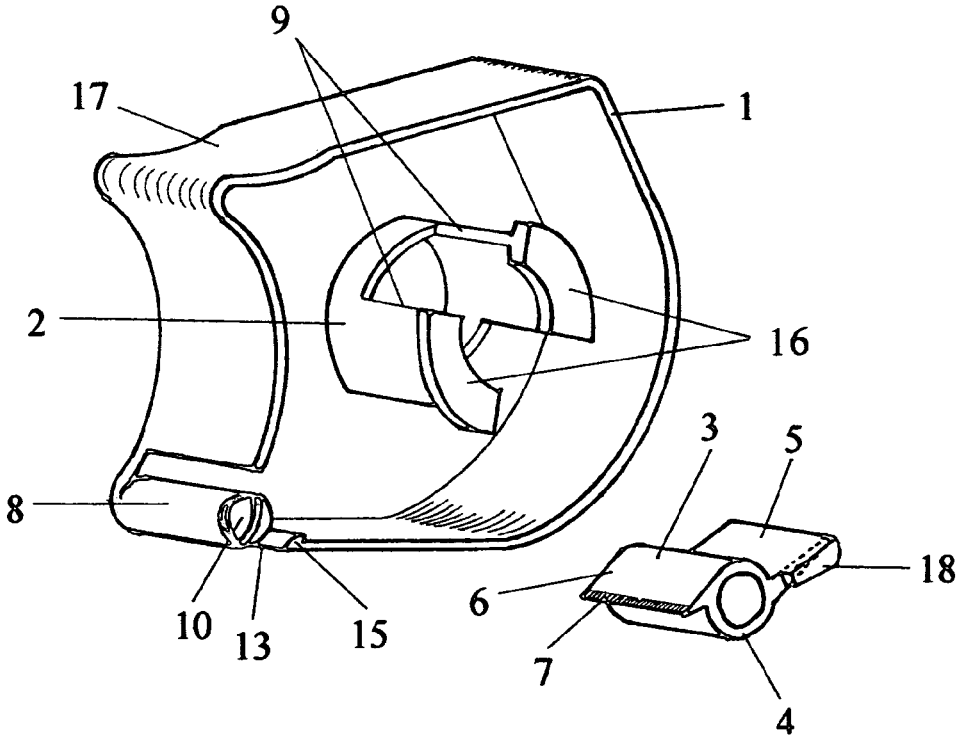

FIG. 2 shows the lever mechanism 3 with a guide cheek 18 included on the outer edge of the depressor lever 5 which purpose is to ensure correct tape position on the guide applicator and preventing unreeling tape from slipping off the lever mechanism 3.

The drawings show the preferred embodiment of the tape dispenser/applicator having only two parts enabling manufacturing cost efficiencies and ease of tape roll replacement. Other embodiments of this tape dispenser/applicator may include a two or more part closed shell and/or other decorative or support structures.

Figure 5:
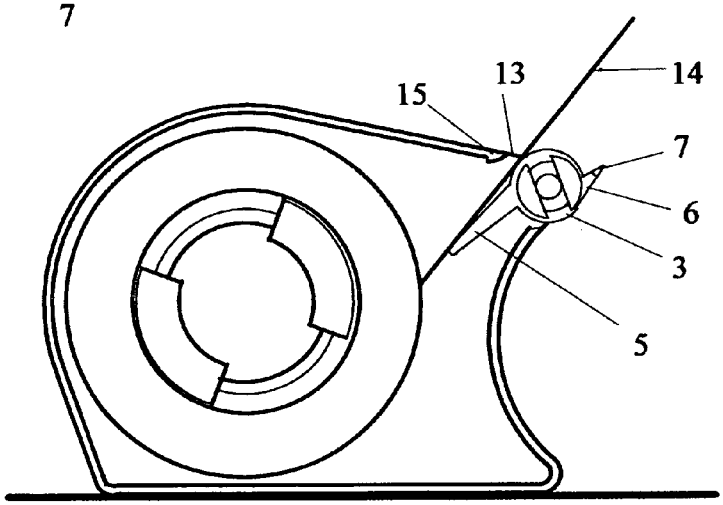

The lever mechanisms 3 enables the tape dispenser/applicator to be used as a desk top tape dispenser as shown in FIG. 5 by simply inverting the dispenser so that the lever mechanism 3 is uppermost. Tape is dispensed by the user pulling a protruding tape end 14 from the discharge opening 13 with the user's fingers. When the requisite length of tape is dispensed, the user pulls the tape end 14 in a downward motion across the cutter lever 6 whereby the tape is locked by the depressor lever 5 at the dispenser lip 15 preventing unreeling of the tape roll 11 as previously described and the tape is severed at the cutting edge 7. The new protruding tape end 14 is lightly adhered at the dispenser lip 15 preventing retraction of the protruding tape end 14 into the housing shell 1 as previously described and ready for it next use. The tape locking and anti lock mechanism described herein may be incorporated into much larger, heavier or more ornate desktop dispensers when used only in the desk top mode.

What is claimed is:

1. A dispenser for applying and cutting rolled adhesive tape having an adhesive side and a non-adhesive side and requiring only one hand operation, said dispenser comprising:

(a) a dispenser housing comprising a partial shell (1) of a size that fits in the palm of one hand and can be gripped and supported by the fingers of one hand, said shell (1) having a support face and a peripheral wall extending transversely from said support face to form an open face housing, said peripheral wall providing a support means for supporting the dispenser in one hand;

(b) a hub (2) mounted upon said housing shell (1) said hub (2) providing a support upon which a roll of adhesive tape (11) wound around a core (12) is detachably mounted so as to rotate freely about said hub (2) and from which adhesive tape is unreeled through a tape discharge opening (13) in said peripheral wall;

(c) a lever mechanism (3) including a tape guide applicator (4) and two approximately diametrically mounted levers mounted for pivoting about a spindle (8) supported for rotation on said housing shell (1) in the proximity of said discharge opening (13), said levers connected to said lever mechanism (3) and extending approximately radially from said spindle (8);

(d) said lever mechanism (3) including a tape depressor lever (5) oriented in the direction of the tape roll (11) providing a means of depressing unreeling tape in the area between the tape roll (11) and said tape discharge opening (13) when actuated by movement of a cutter lever (6);

(e) said lever mechanism (3) including said cutter lever (6) oriented downstream of said discharge opening (13), said cutter lever (6) arranged to move said tape depressor lever (5) about spindle (8); and (f) said cutter lever (6) including at its extremity a cutting edge (7) comprising a serrated edge including a plurality of teeth for cutting unreeled adhesive tape;

(g) said tape guide applicator (4) having a curved pressing surface located between said tape depressor lever (5) and said cutter lever (6); and said lever mechanism (3) providing a means of controlling tape unreeling from said tape roll (11), wherein said lever mechanism (6) is arranged on said spindle (8) such that tilting of said housing shell (1) causes said cutter lever (6) to engage the tape at the substrate and to rotate said cutter lever (6) so as to move said depressor lever 95) thereby closing said tape discharge opening (13) about the unreeling tape preventing said tape roll (11) from unreeling as tape is cut, and said tape depressor lever (5) having a predetermined length such that the extremity of the depressor lever (5) depresses tensioned tape unreeling from said tape roll (11) during taping applications thereby limiting rotation of the depressor lever (5) so as to hold open the discharge opening (13) during tape application; and, said cutter lever (6) having a predetermined length such that leverage imparted to the depressor lever (5) ensures locking of the tape at the discharge opening (13) during tape cutting;

whereby a user can apply and cut adhesive tape repeatedly from the tape dispenser using just one hand, the lever mechanism (3) locking the adhesive tape whilst cutting, allowing tape to unreel whilst dispensing and applying to a substrate and securing the protruding tape end from retracting into the dispenser between taping applications.

2. Tape dispenser according to claim 1 characterized in that said tape guide applicator (4) is mounted independently from said lever mechanism (3).

3. Tape dispenser according to claim 1 characterized in that said tape dispenser function in the manner of a desk top tape dispenser, the dispenser housing shell (1) being inverted with the lever mechanism (3) uppermost and a support structure provided to the housing shell (1) so as to provide freestanding support to the inverted dispenser when placed on a horizontal surface;

whereby tape is withdrawn from the dispenser by the users fingers, the tape end being pulled from said discharge opening (13) and over said lever mechanism and pulling the tape downward across said cutter lever (6) thereby locking the tape at said tape depressor lever (5) and severing the tape at said cutting edge (7).

4. Tape dispenser according to claim 1 characterized in that said dispenser housing shell (1) comprises an enclosed shell.

5. Tape dispenser according to claim 1 characterized in that said hub (2) upon which said tape roll (11) is mounted includes spring fingers (9) which snap over the spool (12) of said tape roll (11) preventing said spool (12) from slipping off said hub (2).

6. Tape dispenser according to claim 1 characterized in that said spindle (8) upon which said lever mechanism (3) is mounted includes spring fingers (1) which snap over a hole in said lever mechanism (3) preventing said lever mechanism (3) from slipping off said spindle (8).

7. Tape dispenser according to claim 1 characterized in that elements are formed of molded plastics material.

8. The method of dispensing and applying adhesive tape having an adhesive side and a non adhesive side onto a substrate and cutting said adhesive tape comprising the steps of:

positioning a roll of adhesive tape in a housing shell (1) in a manner to allow rotation of said roll; and pivotally mounting a lever mechanism (3) on said housing shell (1) to provide tape locking and anti locking means, wherein levers are mounted on a lever mechanism (3) in a predetermined position about a pivot, said lever mechanism (3) including a tape cutter lever (6) arranged so as to move a tape depressor lever (5), said cutter lever (6) having a cutting edge (7) at its extremity, said lever mechanism (3) mounted such that tape unreeling from said tape roll (11) is depressed by movement of said tape depressor lever (5) when actuated by movement of said cutter lever (6); and the tape being under tension during tape application, restricts movement of said tape depressor lever (5) preventing closure of said tape discharge opening (13) thereby enabling unreeling tape to pass through said discharge opening (13) whilst dispensing tape; and at the commencement of a taping application a tape end (14) protruding from said discharge opening (13) is adhered to a substrate surface by the user lightly pressing a tape guide applicator (4), comprising an element of lever mechanism (3), to said substrate and drawing said housing shell (1) backwards across said substrate causing the tape to adhere as it unreels from said tape roll (11); and when a requisite length of tape is dispensed, said housing shell (1) is tilted whilst continuing to press said lever mechanism (3) against the substrate causing said cutter lever (6) to engage the tape and, further tilting of said housing shell (1) causes said lever mechanism (3) to rotate said depressor arm (5) against a small section of unreeling tape squeezing and adhering said tape against said housing shell (1) thereby preventing said tape roll (11) from unreeling; and further tilting of said housing shell (1) accompanied by backward pressure on said housing shell (1) causes the tape to server at said cutting edge (7) whereupon said depressor lever (5) stops depressing the tape; and the newly severed tape end remains adhered to the housing shell (1) preventing the new tape end from retracting or rolling back into the housing shell (1); and at the commencement of the next taping application the said new tape end adhered to the housing shell (1) detaches when the tape end is adhered to a substrate and the housing shell (1) drawn backward across the substrate.

9. Method of dispensing and applying adhesive tape according to claim 8 characterized in that said tape guide applicator (4) is mounted indepedently from said lever mechanism (3).

* * * * *